US009675144B2

(12) United States Patent
McLachlan

(10) Patent No.: US 9,675,144 B2
(45) Date of Patent: Jun. 13, 2017

(54) SELF-SEALING FASTENER AND GARMENT

(71) Applicant: E I DU PONT DE NEMOURS AND COMPANY, Wilmington, DE (US)

(72) Inventor: Colin A McLachlan, Sumter, SC (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 330 days.

(21) Appl. No.: 14/487,191

(22) Filed: Sep. 16, 2014

(65) Prior Publication Data

US 2015/0082518 A1 Mar. 26, 2015

Related U.S. Application Data

(60) Provisional application No. 61/881,053, filed on Sep. 23, 2013.

(51) Int. Cl.

| | |
|---|---|
| ***A44B 18/00*** | (2006.01) |
| ***A41F 1/00*** | (2006.01) |
| ***A41H 37/00*** | (2006.01) |
| ***A44B 19/08*** | (2006.01) |
| ***A44B 19/34*** | (2006.01) |
| *A41H 37/06* | (2006.01) |
| *A41D 3/00* | (2006.01) |

(52) U.S. Cl.

CPC ..... *A44B 18/0069* (2013.01); *A41F 1/00* (2013.01); *A41H 37/001* (2013.01); *A44B 18/0073* (2013.01); *A44B 19/08* (2013.01); *A44B 19/34* (2013.01); *A41D 3/00* (2013.01); *A41H 37/06* (2013.01); *Y10T 24/27* (2015.01)

(58) Field of Classification Search

CPC ..... A41F 15/007; A41F 1/00; A41D 13/012; A41D 3/04; B63C 11/04; A44B 19/32

USPC ..... 2/336, 82, 87, 96, 2.17; 24/384

See application file for complete search history.

(56) References Cited

U.S. PATENT DOCUMENTS

| | | | | |
|---|---|---|---|---|
| 2,422,249 A * | 6/1947 | Malluk | A43B 3/02 | 24/389 |
| 3,449,764 A * | 6/1969 | De Fazio | A41D 27/24 | 2/128 |
| 5,529,823 A * | 6/1996 | Aumann | A41D 3/04 | 2/108 |
| 6,651,254 B1 * | 11/2003 | Chang | A41D 3/04 | 2/87 |

(Continued)

FOREIGN PATENT DOCUMENTS

DE a19755498 A1 * 6/1999 ..... A44B 19/32

*Primary Examiner* — Tejash Patel

(57) ABSTRACT

This invention relates to a fastener assembly and garment comprising same having a first fastener tape and a second fastener tape, and a first edge and a second edge, the first edge having a row of cooperating fastener elements mounted thereon; wherein the second edge of each of the first and second fastener tapes is folded parallel to its row of cooperating fastener elements such that when the fastener is closed, and a meshed area of fastener elements from the first and second fastener tapes is formed, i) the second edges of each of the first and second fastener tapes overlap, ii) the second edge of the first fastener tape fully covers the meshed area of fastening elements, and iii) the overlap of the second edge of the first fastener tape by the second edge of the second fastener tape extends past the meshed area of fastening elements.

13 Claims, 6 Drawing Sheets

(56) References Cited

U.S. PATENT DOCUMENTS

| | | | | |
|---|---|---|---|---|
| 6,668,384 | B1 * | 12/2003 | Chang | A41D 3/00 2/96 |
| 2005/0102729 | A1 * | 5/2005 | Snedeker | A41D 13/0002 2/96 |

* cited by examiner

SELF-SEALING FASTENER AND GARMENT

BACKGROUND OF THE INVENTION

Field of the Invention

This invention relates to an improved fastener assembly suitable for use with protective apparel and a garment comprising that fastener assembly.

Description of Related Art

One function of certain personal protective apparel worn by workers is to prevent or reduce environmental contaminants from contacting the skin. Such apparel can include an encapsulating liquid-resistant and/or chemical-resistant suits or garments, or suits or garments designed to prevent dry particulates, or suits or garments designed to prevent a variety of hazards from contacting the skin. Such apparel can include such things as coveralls, shirts, coats, pants, bib coveralls, or a combination of these items. The apparel can be made with a wide variety of proprietary protective garment fabrics, barrier fabrics, laminates, and films. The apparel can also include nonwoven and/or woven fabrics and laminates of such materials with films. In some embodiments the apparel material is a multilayer-film-and-nonwoven laminate. In some embodiments the apparel material is a nonwoven that resists penetration by liquids and/or particulates.

Clearly, in preventing liquid and/or particulate intrusion into apparel, openings in the apparel are potential weak points, since the openings must be present in order for the apparel to be donned, and after donning the openings must then be adequately sealed. Any improvement in the sealing of such apparel is desired.

BRIEF SUMMARY OF THE INVENTION

This invention relates to a fastener assembly for use with a garment comprising a fastener having a first fastener tape and a second fastener tape, each fastener tape having an inside surface and an outside surface, and a first edge and a second edge, the first edge having a row of cooperating fastener elements mounted thereon; wherein the second edge of each of the first and second fastener tapes is folded parallel to its row of cooperating fastener elements such that when the fastener is closed, and a meshed area of fastener elements from the first and second fastener tapes is formed, i) the second edges of each of the first and second fastener tapes overlap, ii) the second edge of the first fastener tape fully covers the meshed area of fastening elements, and iii) the overlap of the second edge of the first fastener tape by the second edge of the second fastener tape extends past the meshed area of fastening elements.

This invention also relates to a garment comprising protective apparel fabric and a fastener assembly for joining a first and a second area of protective apparel fabric, wherein a) the fastener assembly comprises a fastener having a first fastener tape and a second fastener tape, each fastener tape having an inside surface and an outside surface, and a first edge and a second edge, the first edge having a row of cooperating fastener elements mounted thereon;

wherein the second edge of each of the first and second fastener tapes is folded parallel to its row of cooperating fastener elements such that when the fastener is closed, and a meshed area of fastener elements from the first and second fastener tapes is formed, the second edges of each of the first and second fastener tapes overlap, the second edge of the first fastener tape fully covers the meshed area of fastening elements, and the overlap of the second edge of the first fastener tape by the second edge of the second fastener tape extends past the meshed area of fastening elements;

b) the garment having first stitches attaching the fastener assembly to the to the first area of protective apparel fabric through the first and second edges of the first fastener tape, and second stitches attaching the fastener assembly to the second area of protective apparel fabric through the first and second edges of the second fastener tape, with the proviso the first stitches do not stitch through the second fastener tape and the second stitches do not stitch through the first fastener tape.

This invention further relates to a garment comprising protective apparel fabric and a fastener assembly for joining a first and a second area of protective apparel fabric, wherein a) the fastener assembly comprises a fastener having a first fastener tape and a second fastener tape, each fastener tape having an inside surface and an outside surface, and a first edge and a second edge, the first edge having a row of cooperating fastener elements mounted thereon;

wherein the second edge of each of the first and second fastener tapes is folded parallel to its row of cooperating fastener elements such that when the fastener is closed, and a meshed area of fastener elements from the first and second fastener tapes is formed, the second edges of each of the first and second fastener tapes overlap, the second edge of the first fastener tape fully covers the meshed area of fastening elements, and the overlap of the second edge of the first fastener tape by the second edge of the second fastener tape extends past the meshed area of fastening elements;

b) the garment having first stitches attaching the fastener assembly to the to the first area of protective apparel fabric through the first edge of the first fastener tape, and second stitches attaching the fastener assembly to the second area of protective apparel fabric through the first edge of the second fastener tape, with the proviso the first stitches do not stitch through the second fastener tape and the second stitches do not stitch through the first fastener tape.

DETAILED DESCRIPTION OF THE INVENTION

Fastener Assembly

Figure 1A:
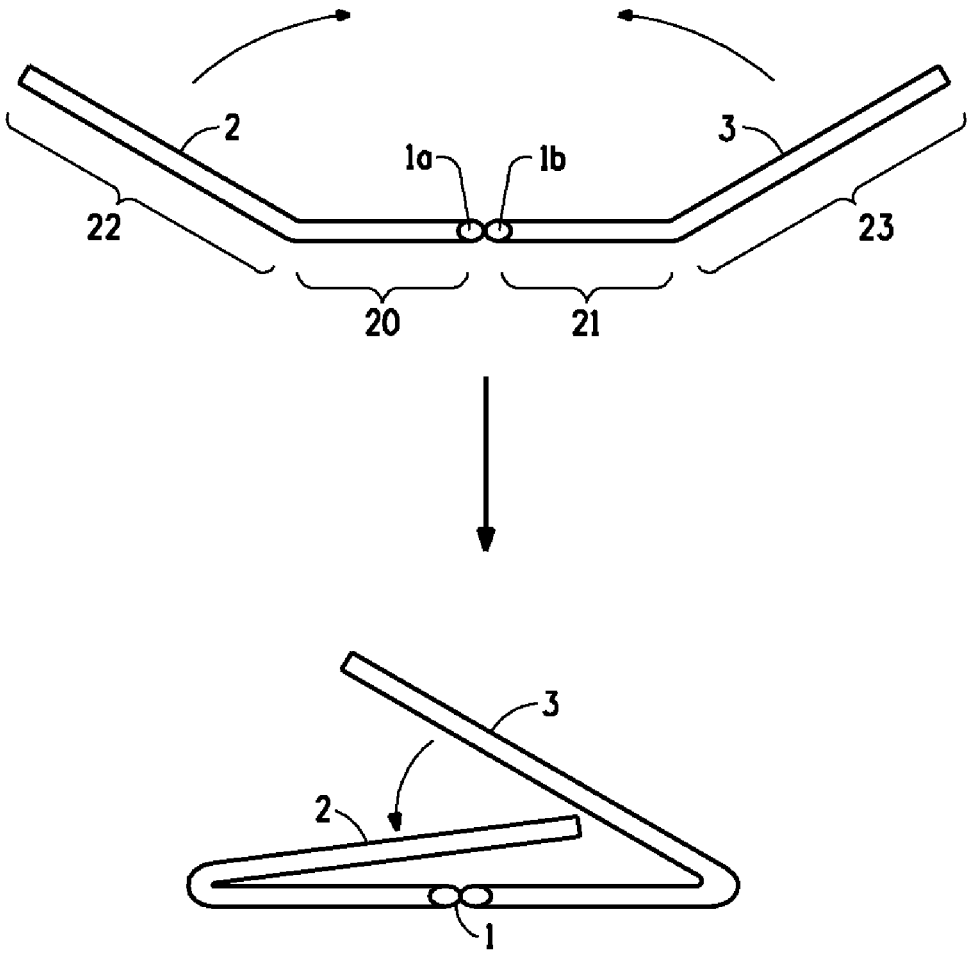
FIG. 1A is a representation of a fastener assembly for use with a garment, shown unfolded and then partially folded for clarity.

As shown in FIG. 1A, the fastener assembly for use with a garment comprises a fastener having a first fastener tape 2 and a second fastener tape 3, each fastener tape having an inside surface and an outside surface. Further, fastener tape 2 has a first edge 20 and a second edge 22 with the first edge having a row of cooperating fastener elements 1*a* mounted thereon; fastener tape 3 has a first edge 21 and a second edge 23 with the first edge having a row of cooperating fastener elements 1*b* mounted thereon.

Further, the length of first edge 20 is shorter than the length of second edge 22 and the length of first edge 21 is shorter than the length of second edge 23. In some embodiments, the fastener tape has barrier properties equivalent to or greater than the barrier properties of the protective apparel fabric that will be joined by the fastener assembly.

Figure 3A:
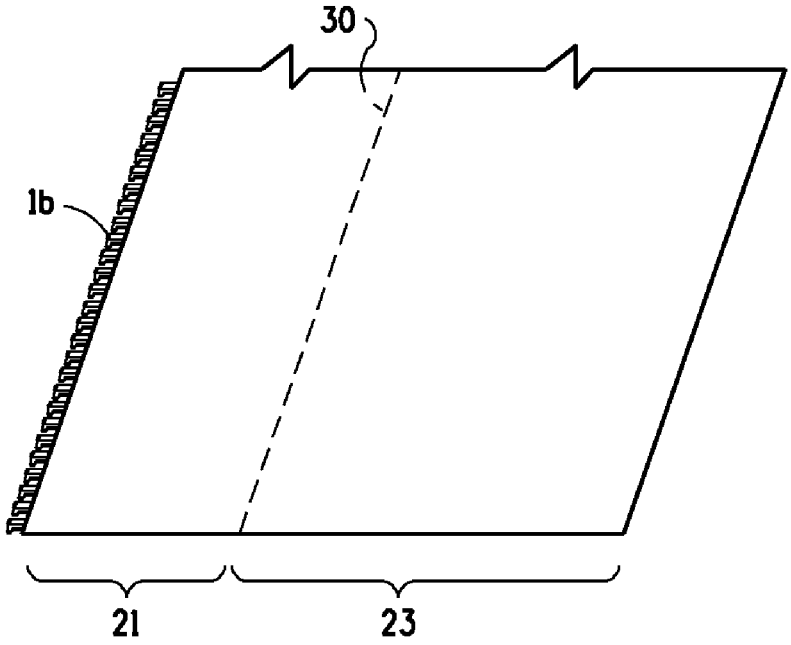
FIG. 3A is a representation of the orientation of the closing tape fold, which is parallel to the row of cooperating fastener elements; in this illustration the fastener elements are one type of slide fastener elements, particularly the teeth on a zipper.
Figure 3B:
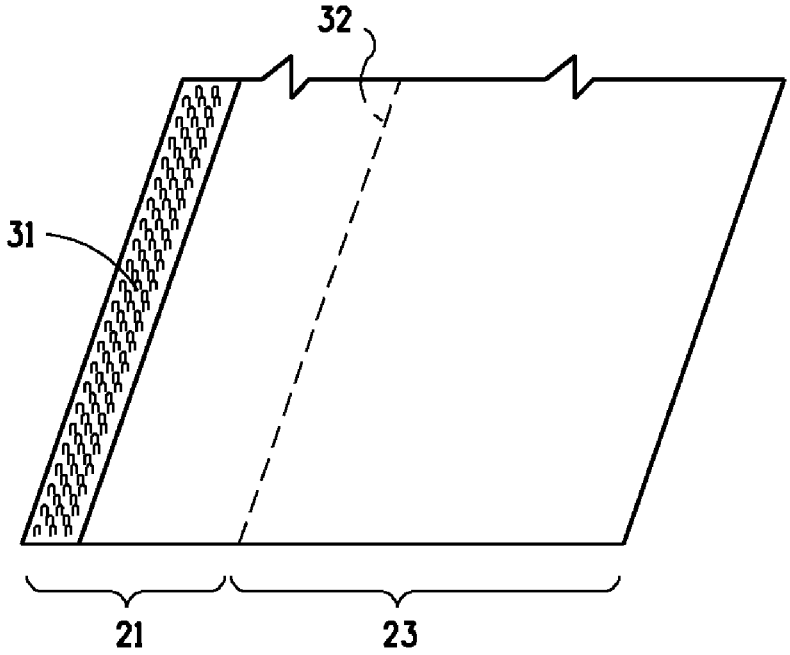
FIG. 3B is a representation of the orientation of the closing tape fold, which is parallel to the row of cooperating fastener elements; in this illustration the fastener elements are one type of velvet-type hook-and-loop fastener.

The first fastener tape 2 is folded parallel to the row of cooperating fastener elements 1*a* on the first fastener tape, and the second fastener tape 3 is folded parallel to the row of cooperating fastener elements 1*b* on the second fastener tape. FIG. 3A is a representation of the orientation of the fastener tape 3 wherein the fold 30 is represented by a dotted line, the fold being parallel to the row of cooperating fastener elements 1*b*; in this illustration the row of fastener elements are one type of slide fastener elements, particularly the teeth on a zipper. FIG. 3B is a similar representation of the orientation of the fastener tape fold 32, which is parallel to the row of cooperating fastener elements 31. In this illustration the row of fastener elements 31 is a strip of one side of the type of velvet-type hook-and-loop fastener such as the one disclosed in U.S. Pat. No. 2,717,437 to de Mestral more commonly known as a Velcro® fastener. Fastener tape 2 has mirror-image corresponding folds, options, and compatible or mating fastener elements to those shown in FIGS. 3A & 3B. While these types of fastener tapes and fastener elements are useful, they are not intended to be limiting. In addition to these, it is believed a variety of fastener tapes and fastener elements can be used, including such things as magnetic sealing strips such as sold by Gooper Hermetic.

The overall length of each of the first and second fastener tapes, and the relative length of the first and second edges of the fastener tapes, is selected such that when the fastener is closed the second edges of each of the first and second fastener tapes overlap, and both cover the closed fastener. In particular, when the fastener is closed, the cooperating fastener elements 1*a* & 1*b* from the first and second fastener tapes mesh together, and the second edge of each fastener tape is selected such that it extends over the meshed area to fully cover that area. As shown in FIG. 1A in partially folded condition for clarity, the length of first fastener tape 2 is selected such that folded second edge 22 covers the outside surface of first edge 20 and extends, or is long enough, to fully cover the meshed area directly beneath it. The length of second fastener tape 3, which overlaps first fastener tape 2, is also independently chosen such that its folded second edge 23 covers a portion of the outside surface of first edge 21 and is long enough to extend past the meshed area of fastening elements, which lie beneath the first fastener tape. In other words, the area of meshed fastening elements is completely covered by two layers of fastener tape that are overlapped above that meshed area, each of the layers being wide enough to fully cover the meshed area independently. This helps ensure the meshed area will be fully sealed from any liquid and/or particulate material.

In some preferred embodiments, the length of first fastener tape 2 is selected such that, when the fastener is closed, the second edge 22 extends to between the meshed area and the fold in fastener tape 3, preferably between one-third to two-thirds the distance between the meshed area and the fold in fastener tape 3. In some embodiments, the length of second fastener tape 3 is selected such that, when the fastener is closed, the second edge 23 extends past the meshed area to at least one-third to two-thirds the distance between the meshed area and the fold in fastener tape 2. In some embodiments the length of second edge 23 is longer than the length of second edge 22. Further, if desired, additional closing devices that can be easily and quickly opened and closed, such as additional strips of a velvet-type hook-and-loop fastener (like a Velcro®-type), other hook/loop devices, doubled-sided adhesive tape, interlocking spline and groove systems (such as zip lock systems), magnetic sealing strips, and the like can be used to secure the second edge 23 of fastener tape 3 to the protective apparel fabric or to fastener tape 2. Likewise, if desired, such additional closing devices can be used to secure the second edge 22 to first edge 21 of fastener tape 3.

While multiple types of fasteners and cooperating fastener elements are contemplated, in a preferred embodiment the fastener is a slide fastener, the first and second fastener tapes are stringer tapes, and the fastener elements are cooperating slide fastener elements mounted on the stringer tapes, with the slide fastener further comprising a slide cooperating with the fastener elements on the stringer tapes to open and close the slide fastener. Some slide fasteners are commonly known as "zippers".

Garment

The garment preferably comprises a protective apparel fabric and the fastener assembly as previously described. The term "protective apparel fabric" is meant to include a wide variety of protective garment fabrics, barrier fabrics, laminates, and films. The term "protective apparel fabric" also includes nonwoven and/or woven fabrics and laminates of such materials with films or multilayer films. In some preferred embodiments the protective apparel fabric, and therefore the apparel material, is a multilayer-film-and-nonwoven laminate. In some embodiments the apparel material is a nonwoven that resists penetration by liquids and/or particulates, such as a nonwoven like Tyvek® spunbonded polyethylene. Other useful protective apparel fabrics protect against a wide variety of threats and include but are not limited to those disclosed in U.S. Pat. No. 5,626,947 (Hauer et al.); U.S. Pat. No. 4,855,178 (Langley); U.S. Pat. No. 4,272,851 (Goldstein); U.S. Pat. No. 4,772,510 (McClure); U.S. Pat. No. 5,035,941 (Blackburn); U.S. Pat. No. 4,214,321 (Nuwayser); U.S. Pat. No. 4,920,575 (Bartasis); U.S. Pat. No. 5,162,148 (Boye); U.S. Pat. No. 4,833,010 (Langley).

Figure 1B:
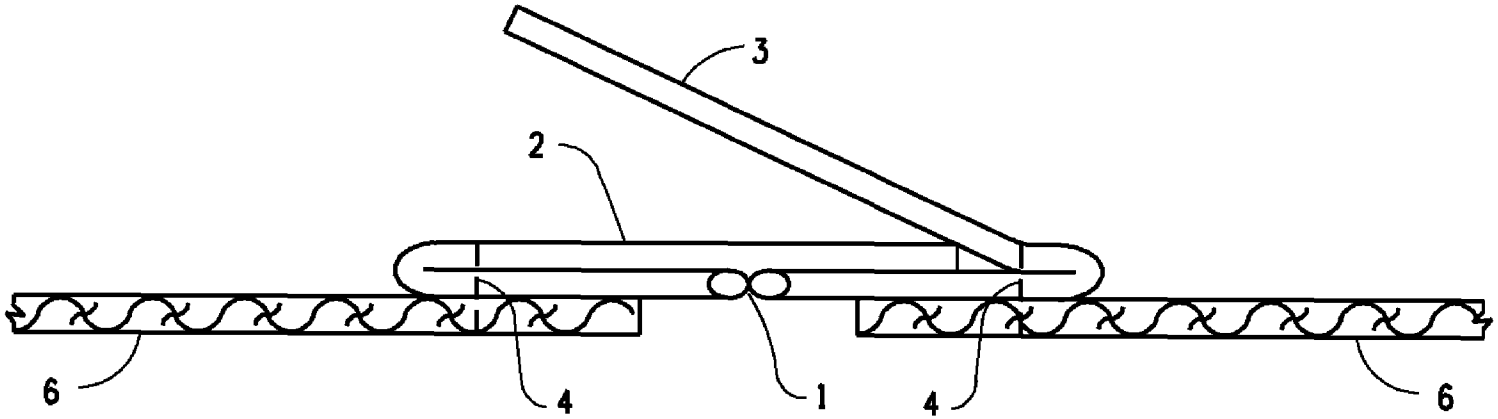
FIG. 1B is a representation of a fastener assembly in a partially folded condition for clarity and attached to first and second areas of apparel fabric

As shown in FIG. 1B, the fastener assembly joins first and second areas 6 of protective apparel fabric. The garment has stitches 4 attaching the fastener assembly to the first and second areas 6 of protective apparel fabric. In one embodiment, the first set of stitches 4 are sewn through the first and second edges of the first fastener tape 2 and the first area of protective apparel fabric; and the second set of stitches are sewn through the first and second edges of the second fastener tape 3 and the second area of protective apparel fabric. However, so that the fastener can be opened and closed, the first stitches through the first fastener tape 2 do not stitch through the second fastener tape 3, and the second stitches through the second fastener tape 3 do not stitch through the first fastener tape 2.

Figure 2A:
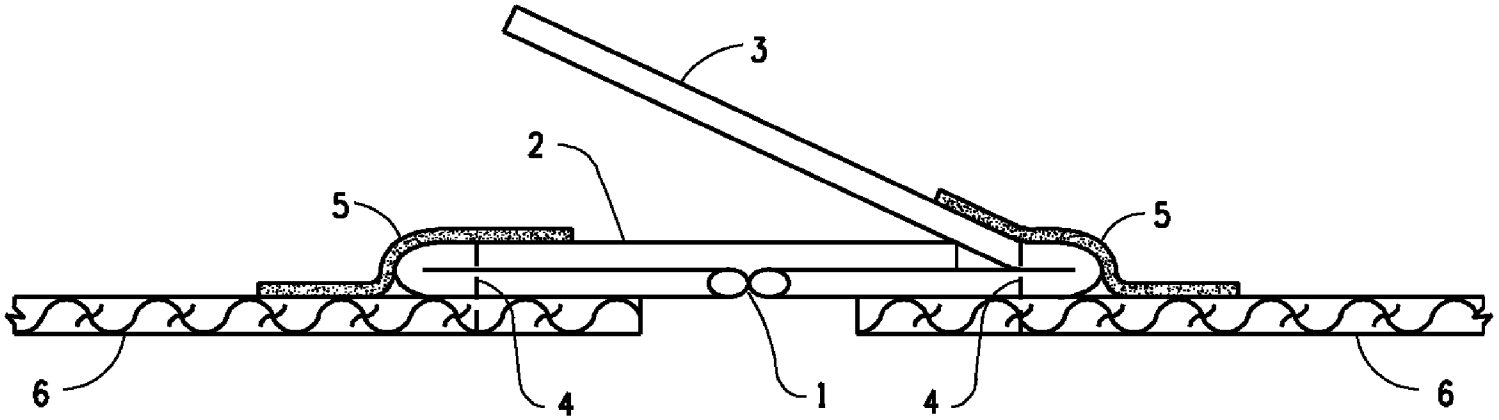
FIG. 2A is a representation of a fastener assembly in a partially folded condition for clarity and attached to first and second areas of apparel fabric and with optional sealing tape.

Further, as shown in FIG. 2A, in some embodiments after the fastener assembly is stitched to the areas of protective fabric, the first fastener tape 2 is further attached to the first area of protective apparel with outer sealing tape 5 that covers the first stitches. Likewise the second fastener tape 3 is also attached to the second area of protective apparel with outer sealing tape 5 that covers the second stitches. The outer sealing tape 5 should be compatible with both the closing tape material and the protective fabric, and it also serves to cover the joint between the protective apparel fabric area and the folds in the closing tapes. Useful sealing tapes include tapes that are made from the barrier and resistant components of the protective apparel fabric. In some embodiments, the outer sealing tape 5 is made from the protective apparel fabric used in the garment. Representative commercially available outer sealing tapes are obtainable from such manufacturers as the Adhesive Films, Inc., Bemis Associates, Inc., Worthen Industries, and others; with the tape adhesives including polyurethane, polyethylene, acrylic, thermoplastic rubber, and/or hot melt systems, and others.

Figure 2B:
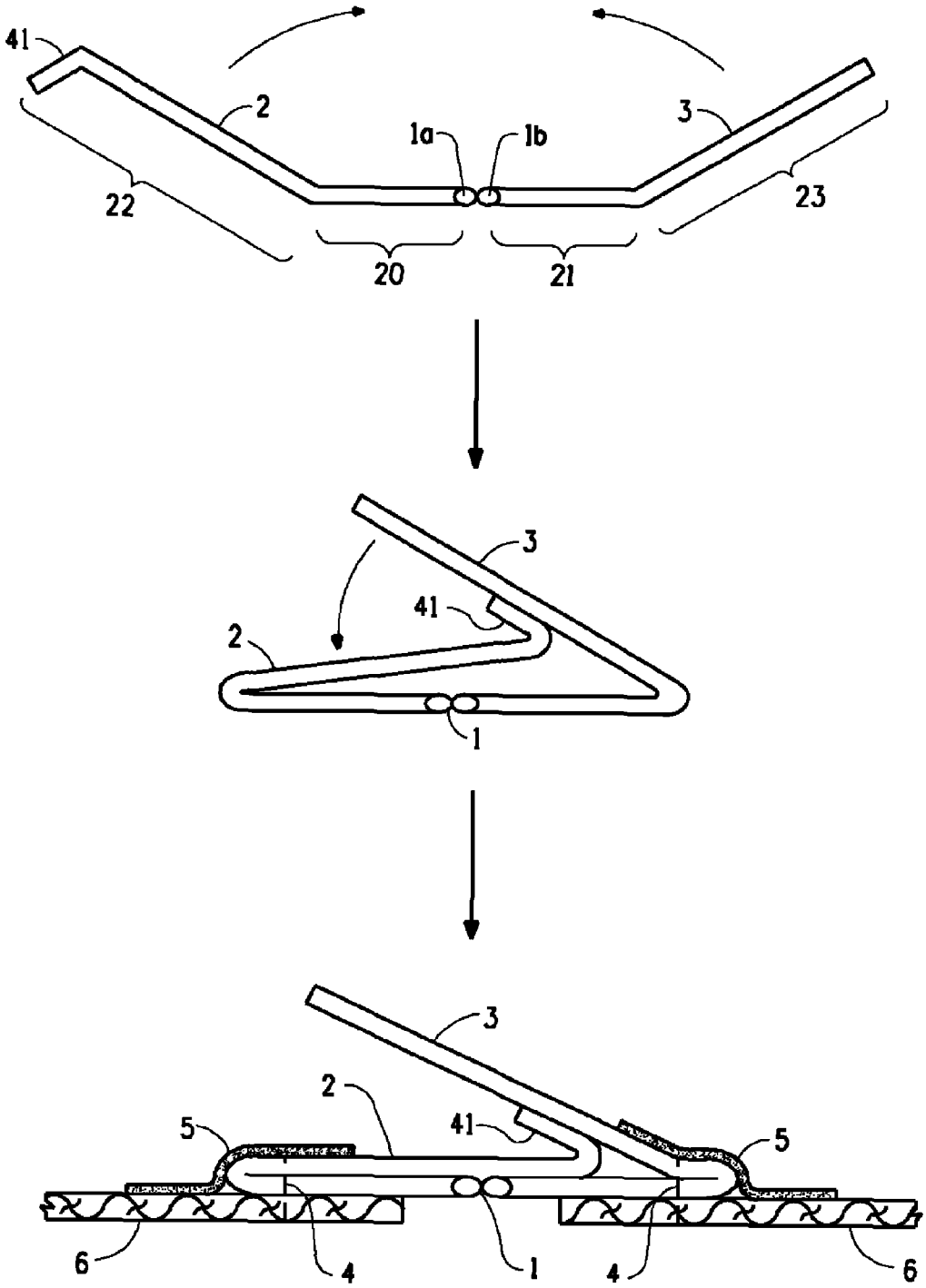
FIG. 2B is an alternate representation of a fastener assembly for use with a garment, shown unfolded and partially folded condition for clarity, and then attached to first and second areas of apparel fabric, with optional sealing tape.

FIG. 2B illustrates a feature that can be used in the fastener assembly and its attachment to the protective apparel fabric. In this embodiment, the second edge 22 of first fastener tape 2 has an additional reverse fold forming internal flap 41. The length of internal flap 41 is shorter than any of the first or second edges. Like the mirror image to fold 30 (as shown in FIG. 3A), the fold in the first fastener tape 2 creating internal flap 41 is parallel to both the fold and the row of cooperating fastener elements 1*a* but in the opposite direction. As shown in partially folded condition for clarity in FIG. 2B, when the fastener is attached to first and second areas 6 of protective apparel fabric via stitches and optional outer sealing tape 5 and then closed, the reverse fold of internal flap 41 nests in the fold underneath second fastener tape 3 between first edge 21 and second edge 23 and provides a further coverage to the second fastener stitched area. It is believed internal flap 41 can help prevent any material or liquid that might inadvertently get underneath edge 23 from reaching the stitched area of second fastener tape 3.

Figure 4:
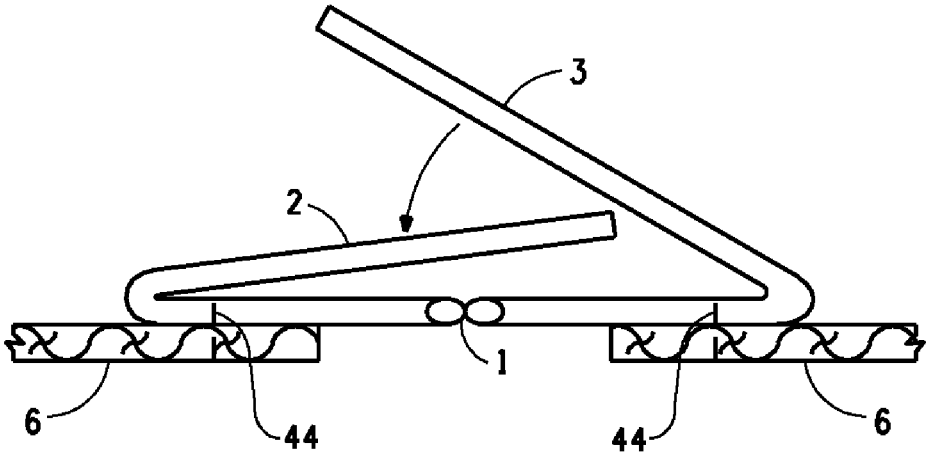
FIG. 4 is a representation of another attachment of a fastener assembly to first and second areas of apparel fabric, with optional sealing tape, shown in a partially folded condition for clarity.

FIG. 4 illustrates another embodiment of a fastener assembly and its attachment to first and second areas of apparel fabric which finds use in garments where the threat is primarily particulate intrusion. The fastener assembly joins first and second areas 6 of protective apparel fabric. The garment has stitches 44 attaching the fastener assembly to the first and second areas 6 of protective apparel fabric. In this embodiment, the first set of stitches 44 are sewn through the first edge 20 of fastener tape 2 and the first area of protective apparel fabric 6; and the second set of stitches 44 are sewn through the first edge 21 of second fastener tape 3 and the second area of protective apparel fabric 6. However, so that the fastener can be opened and closed, the first stitches through the first fastener tape 2 do not stitch through the second fastener tape 3, and the second stitches through the second fastener tape 3 do not stitch through the first fastener tape 2. Further, in this embodiment, the stitches only pass through the first edges of the fastener tapes; the stitches do not pass through the second edges (22, 23). As before, if desired, additional closing devices that can be easily and quickly opened and closed, such as additional strips of a velvet-type hook-and-loop fastener (like a Velcro®-type), other hook/loop devices, doubled-sided adhesive tape, interlocking spline and groove systems (such as zip lock systems), magnetic sealing strips, and the like can be used to secure the second edge 23 of fastener tape 3 to the protective apparel fabric or to fastener tape 2. Likewise, such additional closing devices can be used to secure the second edge 22 of fastener tape 2 to the first edge 21 of fastener tape 3.

In some embodiments, the fastener in the fastener assembly in the garment is a slide fastener, the first and second fastener tapes are stringer tapes, and the fastener elements are cooperating slide fastener elements mounted on the stringer tapes. The slide fastener further comprises a slide cooperating with the fastener elements on the stringer tapes to open and close the slide fastener. In some embodiments, the fastener in the fastener assembly in the garment is a velvet-type hook-and-loop fastener having hook and loop fastener elements. Suitable slide fasteners include, for example, urethane-coated water resistant zippers such as YKK® Aquaguard® uretek coated zippers or other water resistant zippers coated with urethane, polyethylene, or other water resistant coatings. Preferably the slide fastener has an overall length equal to the garment opening being closed. In some embodiments, the slide fastener has an overall length of from 30 to 48 inches.

While in the garment this type of fastener tapes and fastener elements is useful, is are not intended to be limiting. All of the features previously described for the fastener assembly can be used in the garment. For example, it is believed a variety of fastener tapes and fastener elements can be used, including velvet-type hook-and-loop fastener such as the one disclosed in U.S. Pat. No. 2,717,437 to de Mestral more commonly known as a Velcro® fastener.such things as magnetic sealing strips such as sold by Gooper Hermetic.

In some embodiments the garment comprising protective apparel fabric and the fastener assembly is a Level B, C or D protective garment. Level B garments are used in situations that require the highest level of respiratory protection but a lesser level of skin protection is needed. Level C garments are used in situations where atmospheric contaminants, liquid splashes, and other direct contact will not adversely affect or be absorbed by any exposed skin. Level D garments are used in situations where contamination is only a nuisance. There may be some instances where combinations of protective apparel rated for B, C, or D level may be used together.

Test Methods

Garments incorporating this closure can be tested by (1) resistance to penetration by spray according to EN 468; (2) resistance to penetration by jets of liquid according to EN 463; (3) limited protection against liquid mist according to ISO 16602 Type 6 as tested by ISO 17491 methods; (4) resistance to penetration by spray according to ISO 16602 Type 4 as tested by ISO 17491 methods; (5) resistance to penetration by jets of liquid according to ISO 16602 Type 3 as tested by ISO 17491 methods; and (6) resistance to protection airborne hazardous particles according to ISO 16602 Type 5 as tested by ISO 17491 methods.

Example 1

A fastener assembly is made by mounting slide fastener elements onto as the first and second fastener tapes that are stringer tapes of Tyvek® spunbonded polyolefin along with a slide fastener for closing the fastener elements. The fastener is folded as generally illustrated in FIG. 1A. The width of the first fastener tape (2) is chosen such that when folded, it has a first edge (20) that is approximately ⅞ inches wide and a second edge (22) that is approximately 1 inch wide. The width of the second fastener tape (3) is chosen such that when folded, it has a first edge (21) that is approximately ⅞ inches wide and a second edge (23) that is approximately 1.5 inches wide. The overall length of the slide fastener is approximately 36 inches long.

When the fastener is closed, that is, the fastening elements are meshed, the second edge 22 of the first fastener tape 2 extends past the meshed area, and the second edge 23 of the second fastener tape 3 extends past the meshed area to between the meshed area and the fold in fastener tape 2.

Example 2

A garment in the form of a coverall design to limit resist the ingress of liquids is made by incorporating the fastener assembly of Example 1 at the entry opening of coveralls. The fastener assembly is attached to first and second areas of Tyvek® spunbonded polyolefin protective apparel fabric to join that fabric at the entry point in the coveralls. The fastener assembly is stitched to the first and second areas of the Tyvek® protective apparel fabric as shown in FIG. 1B. In particular, first stitches 4 are sewn through the first and second edges of the first fastener tape 2 and the first area of protective apparel fabric and second stitches 4 are sewn through the first and second edges of the second fastener tape 3 and the second area of protective apparel fabric. However, so that the fastener can be opened and closed, the first stitches through the first fastener tape 2 do not stitch through the second fastener tape 3, and the second stitches through the second fastener tape 3 do not stitch through the first fastener tape 2. As shown in FIG. 2A, seam sealing tape compatible (through adhesion or cohesion) with the garment material and compatible with the zipper material is applied to cover the stitches and the joint between the fastener assembly and the protective apparel fabric.

The garment is tested via ISO 17491 for ISO 16602 types 3, 4, & 6, along with EN 468 & EN463, and shows no ingress of liquid through the fastener assembly.

Example 3

A garment in the form of a coverall design to limit resist the ingress of particulates is made by incorporating the fastener assembly of Example 1 at the entry opening of the garment. The fastener assembly is attached to first and second areas of Tyvek® spunbonded polyolefin protective apparel fabric to join that fabric at the entry point in the coveralls. The fastener assembly is stitched to the first and second areas of the Tyvek® protective apparel fabric as shown in FIG. 4. In particular, first stitches 44 are sewn through just the first edge of the first fastener tape 2 and the first area of protective apparel fabric and second stitches 44 are sewn through just the first edges of the second fastener tape 3 and the second area of protective apparel fabric. The stitches do not go through either the second edges of either fastener tape. Further, so that the fastener can be opened and closed, the first stitches through the first fastener tape 2 do not stitch through the second fastener tape 3, and the second stitches through the second fastener tape 3 do not stitch through the first fastener tape 2. Since the goal is to eliminate particulate ingress, as shown in FIG. 4, sealing tape is not needed. However, if desired, it can be applied if desired to cover the joint between the fastener assembly and the protective apparel fabric.

The garment is tested via ISO 17491 for ISO 16602 type 5 and shows no ingress of particulates through the fastener assembly.

Example 4

Examples 1 thru 3 are repeated, however, the fastener assembly is constructed with the previously-described internal flap feature 41 as shown in FIG. 2B. As in Examples 2 and 3, the garments show no ingress of liquid/particulates through the fastener assembly.

The invention claimed is:

1. A fastener assembly for use with a garment comprising a fastener having a first fastener tape and a second fastener tape, each fastener tape having an inside surface and an outside surface, and a first edge and a second edge, the first edge having a row of cooperating fastener elements mounted thereon;

wherein the second edge of each of the first and second fastener tapes is folded parallel to its row of cooperating fastener elements such that when the fastener is closed, and a meshed area of fastener elements from the first and second fastener tapes is formed, i) the second edges of each of the first and second fastener tapes overlap, ii) the second edge of the first fastener tape fully covers the meshed area of fastening elements, and iii) the overlap of the second edge of the first fastener tape by the second edge of the second fastener tape extends past the meshed area of fastening elements.

2. The fastener assembly of claim 1 further comprising a reverse fold forming an internal flap on the second edge of the first fastener tape, such that when the fastener is closed, the fold of the internal flap nests underneath the second fastener tape between its first edge and its second edge.

3. The fastener assembly of claim 1 wherein the fastener is a slide fastener, the first and second fastener tapes are stringer tapes, and the fastener elements are cooperating slide fastener elements mounted on the stringer tapes, with the slide fastener further comprising a slide cooperating with the fastener elements on the stringer tapes to open and close the slide fastener.

4. The fastener assembly of claim 1 wherein the fastener is a hook and loop fastener having hook and loop fastener elements.

5. A garment comprising protective apparel fabric and a fastener assembly for joining a first and a second area of protective apparel fabric, wherein a) the fastener assembly comprises a fastener having a first fastener tape and a second fastener tape, each fastener tape having an inside surface and an outside surface, and a first edge and a second edge, the first edge having a row of cooperating fastener elements mounted thereon;

wherein the second edge of each of the first and second fastener tapes is folded parallel to its row of cooperating fastener elements such that when the fastener is closed, and a meshed area of fastener elements from the first and second fastener tapes is formed, the second edges of each of the first and second fastener tapes overlap, the second edge of the first fastener tape fully covers the meshed area of fastening elements, and the overlap of the second edge of the first fastener tape by the second edge of the second fastener tape extends past the meshed area of fastening elements;

b) the garment having first stitches attaching the fastener assembly to the to the first area of protective apparel fabric through the first and second edges of the first fastener tape, and second stitches attaching the fastener assembly to the second area of protective apparel fabric through the first and second edges of the second fastener tape, with the proviso the first stitches do not stitch through the second fastener tape and the second stitches do not stitch through the first fastener tape.

6. The garment of claim 5 wherein the first fastener tape is further attached to the first area of protective apparel with a sealing tape that covers the first stitches, and wherein the second fastener tape is further attached to the second area of protective apparel with a sealing tape that covers the second stitches.

7. The garment of claim 5 wherein the fastener assembly further comprising a reverse fold forming an internal flap on the second edge of the first fastener tape, such that when the fastener is closed, the fold of the internal flap nests underneath the second fastener tape between its first edge and its second edge.

8. The garment of claim 5 wherein the fastener is a slide fastener, the first and second fastener tapes are stringer tapes, and the fastener elements are cooperating slide fastener elements mounted on the stringer tapes, with the slide fastener further comprising a slide cooperating with the fastener elements on the stringer tapes to open and close the slide fastener.

9. The garment of claim 5 wherein the fastener is a hook and loop fastener having hook and loop fastener elements.

10. A garment comprising protective apparel fabric and a fastener assembly for joining a first and a second area of protective apparel fabric, wherein a) the fastener assembly comprises a fastener having a first fastener tape and a second fastener tape, each fastener tape having an inside surface and an outside surface, and a first edge and a second edge, the first edge having a row of cooperating fastener elements mounted thereon;

wherein the second edge of each of the first and second fastener tapes is folded parallel to its row of cooperating fastener elements such that when the fastener is closed, and a meshed area of fastener elements from the first and second fastener tapes is formed, the second edges of each of the first and second fastener tapes overlap, the second edge of the first fastener tape fully covers the meshed area of fastening elements, and the overlap of the second edge of the first fastener tape by the second edge of the second fastener tape extends past the meshed area of fastening elements;

b) the garment having first stitches attaching the fastener assembly to the to the first area of protective apparel fabric through the first edge of the first fastener tape, and second stitches attaching the fastener assembly to the second area of protective apparel fabric through the first edge of the second fastener tape, with the proviso the first stitches do not stitch through the second fastener tape and the second stitches do not stitch through the first fastener tape.

11. The garment of claim 10 wherein the fastener assembly further comprising a reverse fold forming an internal flap on the second edge of the first fastener tape, such that when the fastener is closed, the fold of the internal flap nests underneath the second fastener tape between its first edge and its second edge.

12. The garment of claim 10 wherein the fastener is a slide fastener, the first and second fastener tapes are stringer tapes, and the fastener elements are cooperating slide fastener elements mounted on the stringer tapes, with the slide fastener further comprising a slide cooperating with the fastener elements on the stringer tapes to open and close the slide fastener.

13. The garment of claim 10 wherein the fastener is a hook and loop fastener having hook and loop fastener elements.

* * * * *